United States Patent [19]

Miyahara

[11] 3,986,815

[45] Oct. 19, 1976

[54] BURNER FOR BURNING LIQUID FUEL IN GASIFIED FORM

[75] Inventor: Kingo Miyahara, Tokyo, Japan

[73] Assignee: Dowa Co., Ltd., Tokyo, Japan

[22] Filed: Apr. 16, 1975

[21] Appl. No.: 568,723

[30] Foreign Application Priority Data

| | | |
|---|---|---|
| Apr. 24, 1974 | Japan | 49-46725[U] |
| June 17, 1974 | Japan | 49-70586[U] |
| July 15, 1974 | Japan | 49-83535[U] |
| July 15, 1974 | Japan | 49-83536[U] |

[52] U.S. Cl. ..... 431/168; 239/214.17; 239/214.25; 431/242

[51] Int. Cl.[2] ..... F23D 11/04

[58] Field of Search ..... 431/168, 210, 190, 8, 431/242; 239/214.17, 214.25

[56] References Cited

UNITED STATES PATENTS

| | | | |
|---|---|---|---|
| 1,572,591 | 2/1926 | Cannon | 431/168 |
| 3,021,892 | 2/1962 | Brola | 431/168 X |

*Primary Examiner*—Edward G. Favors
*Attorney, Agent, or Firm*—Hill, Gross, Simpson, Van Santen, Steadman, Chiara & Simpson

[57] ABSTRACT

A burner wherein a fuel gasifying member is non-rotatably mounted in a main body of the burner and maintained in communication with a gas chamber formed in an outer marginal portion of the main body of the burner, and liquid fuel scattering means is rotatably mounted at an open end portion of the fuel gasifying member for scattering a liquid fuel in minuscule particles into the interior of the fuel gasifying member and the main body of the burner through a scattering gap. The liquid fuel thus scattered in the main body is ignited and burns to heat the fuel gasifying member in which the fuel supplied by the liquid fuel scattering means under the influence of an air blast supplied under pressure through an air supply duct is quickly gasified and forms a mixture of gasified fuel and air which is ejected through the gas chamber to sustain combustion of the liquid fuel in gasified form. A cooling chamber may be provided adjacent an inner wall plate of the main body of the burner. Heat dissipating fins may be attached to inner periphery of the non-rotatable fuel gasifying member. A cylindrical air guide may be arranged within the fuel gasifying member and maintained in communication with the air supply duct, with a narrow gasified fuel air mixture passageway being formed between the cylindrical air guide and the fuel gasifying member and connected to the gas chamber.

4 Claims, 11 Drawing Figures

BURNER FOR BURNING LIQUID FUEL IN GASIFIED FORM

This invention relates to a novel and useful burner for burning liquid fuel in gasified form.

A burner for burning liquid fuel in gasified form which has as its objects a reduction in the consumption of fuel and an increase in combustion temperature which can be accomplished by burning a liquid fuel in gasified form without producing any noise and odor would, if it is desired to burn the liquid fuel in gasified form from the beginning, require a fuel gasifying device of the complex construction As a result, such burner would be high in cost and troublesome to operate.

It has been discovered that, by adopting the art of burning a liquid fuel in gasified form by simple means whereby the liquid fuel is first burned in atomized particles and the temperature of the fuel gasifying member is quickly brought to a gasifying atmosphere temperature by heating the member by the flames of combustion of the liquid fuel in atomized particles, it is possible readily to switch the burner from combustion of the liquid fuel in atomized particles to combustion of the liquid fuel in gasified form without using any fuel gasifying device of the complex construction. The aforementioned art can have application only in burners in which the fuel gasifying member is rotated, and the art can have no application in burners for burning liquid fuel in gasified form wherein the fuel gasifying member is non-rotatably mounted in the main body of the burner.

Experiments have been conducted to spray the fuel gasifying member with a liquid fuel in atomized particles and burn the scattered atomized particles of fuel for pre-heating the fuel gasifying member which remains stationary without rotating. The results obtained show that the use of such art causes formation of soot due to imperfect combustion of the liquid fuel within the fuel gasifying member. The soot adheres to the inner wall surface of the fuel gasifying member and interferes with combustion in atomized particles of additional liquid fuel supplied later on to the fuel gasifying member. Moreover, production of a gasified fuel is prevented, making it impossible to produce an optimum amount of gasified fuel. Meanwhile, if the fuel gasifying member is made of a thin metallic material, e.g. sheet metal, the fuel gasifying member would be damaged by the flames of combustion. Thus, this device would have no practical value.

Accordingly, a main object of the invention is to provide a burner for burning liquid fuel in gasified form wherein a liquid fuel supplied to the interior of main body of the burner can be positively converted into atomized particles and scattered therein to ensure that the liquid fuel burns in atomized particles, even if the fuel gasifying member is non-rotatably mounted in the main body of the burner, and wherein the liquid fuel can be quickly converted into gasified form within the fuel gasifying member by the heating action of the flames of combustion of the liquid fuel in atomized particles after combustion of the liquid fuel in atomized particles is initiated in the main body, so that the gasified fuel produced in this way can be thoroughly mixed with air supplied under pressure to the interior of the fuel gasifying member and the burner can be automatically switched from combustion of the liquid fuel in atomized particles to combustion of a mixture of gasified fuel and air.

Another object of the invention is to provide a burner for burning liquid fuel in gasified form wherein the fuel gasifying member open at one end is non-rotatably mounted in the main body of the burner which receives an air supply duct inserted through one end portion thereof open therein, and wherein a liquid fuel is first burned in atomized particles within the main body of the burner and then the fuel is converted into gasified form within the fuel gasifying member, the fuel in gasified form thus produced being mixed with air supplied under pressure to form a mixture of gasified fuel and air which is uniformly ejected through the combustion plate to sustain combustion of the fuel in gasified form.

Another object of the invention is to provide a burner for burning liquid fuel in gasified form which comprises liquid fuel scattering means rotatably mounted at an open end of the fuel gasifying member non-rotatably mounted in the main body of the burner, the liquid fuel scattering means being effective to quickly scatter in atomized particles on the inner wall surface of the fuel gasifying member the liquid fuel which has previously been caused to diffuse and move along the inner wall surface of the fuel gasifying member toward its open end.

Still another object of the invention is to provide a burner for burning liquid fuel in gasified form wherein the fuel gasifying member is heated by the flames of combustion of the liquid fuel in atomized particles to convert the liquid fuel into gasified form within the fuel gasifying member which gasified fuel is mixed with air supplied under pressure so as to produce a perfect mixture of gasified fuel and air, such mixture of gasified fuel and air being introduced under pressure into the gas chamber from which the gasified fuel-air mixture is ejected through the combustion plate to sustain combustion of fuel in gasified form.

Still another object of the invention is to provide a burner for burning liquid fuel in gasified form wherein a cooling chamber is formed and arranged on the inner wall plate side of the main body of the burner which has at its peripheral portion the gas chamber, part of the air blast supplied under pressure through the air supply duct being introduced into the cooling chamber from which the air is ejected through air ejection slits into a portion of the interior of the main body of the burner in which the liquid fuel is scattered in atomized particles, so that no damage will be caused by the flames of combustion of the liquid fuel in atomized particles to the fuel gasifying member even if the latter is made of a thin metallic material, whereby the burner can be smoothly switched from combustion of the liquid fuel in atomized particles to combustion of the liquid fuel in gasified form and at the same time atomization of the liquid fuel in minuscule particles can be further promoted.

A still another object of the invention is to provide a burner for burning liquid fuel in gasified form wherein the fuel gasifying member non-rotatably mounted in the main body of the burner is provided on its inner periphery with a multitude of heat dissipating fins so as to enable the fuel gasifying member to perform the function of gasifying a liquid fuel for a proponged time interval even if the member is made of a thin metallic material.

A further object of the invention is to provide a burner for burning liquid fuel in gasified form which comprises a cylindrical air guide communicating with the air supply duct and inserted deep into the interior of the fuel gasifying member so as to define a narrow gasified fuel-air mixture passageway between the fuel gasifying member and the cylindrical air guide, whereby the gasified fuel produced in the fuel gasifying member and the air blast supplied under pressure can be thoroughly agitated to form a perfect mixture of gasifed fuel and air which can be supplied under pressure to the gas chamber.

Additional and other objects and features of the invention will become evident from the description set forth hereinafter when considered in conjunction with the accompanying drawings, in which.

Figure 1:
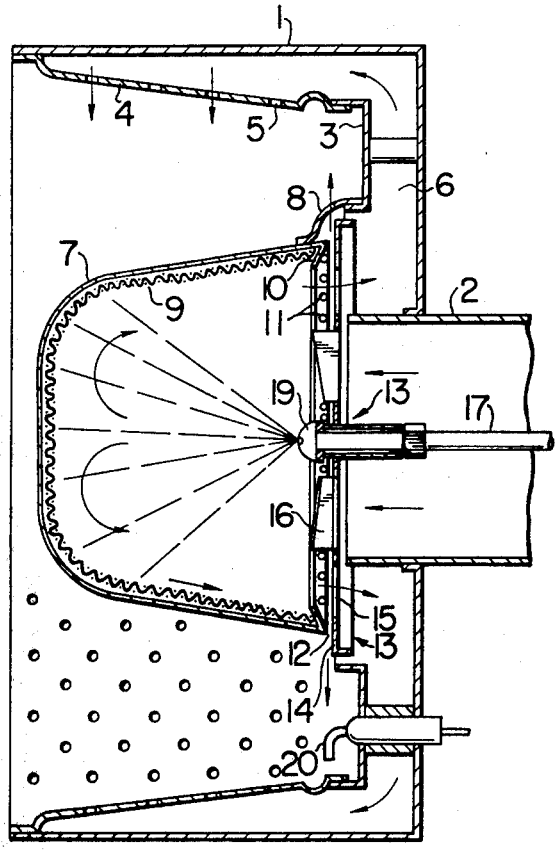
FIG. 1 is a vertical sectional view, with certain parts being cut out, of a basic form of the burner for burning liquid fuel in gasified form according to the invention.

A basic form of the burner for burning liquid fuel in gasified form according to the invention will now be described with reference to FIG. 1 to FIG. 3.

1 refers to a main body of the burner made of a thin metallic material, e.g. sheet metal, which is open at one end and which receives at the other end an air supply duct 2 inserted thereinto. The main body 1 of the burner has mounted along its inner periphery an inner wall plate 3 and a combustion plate 4 to define a gas chamber 6 between the periphery of the main body 1 on the one hand and the inner wall plate 3 and the combustion plate 4 on the other. The combustion plate 4 is formed therein with a multitude of gas ejection ports 5.

The gas chamber 6 is formed substantially in its central position with an opening and communicates therethrough with a fuel gasifying member 7 through an opening formed at one end thereof, with the fuel gasifying member 7 being rigidly mounted through mounting bars 8 on the inner wall plate 3. The fuel gasifying member 7 has mounted on its entire inner wall surface a flow-down preventing member 9 in the form of a wire net, and is formed integrally at its open end portion with a gas-air mixing plate 10 which tilts inwardly and which is formed in its periphery with a multitude of outlet ports 11. The gas-air mixing plate 10 may be formed separately from the fuel gasifying member 7 and attached thereto by suitable means.

Fuel scattering means 13 is rotatably disposed at the open end portion of the fuel gasifying member 7, with a scattering gap 12 of a suitable size being formed between liquid fuel gasifying member 7 and the fuel scattering means 13. As shown in FIG. 1 and FIG. 3, the liquid fuel scattering means 13 is produced by working on a disk by means of a press and comprises an annular scattering surface 14 disposed at the outermost side, gas passageways 15 disposed inwardly of the annular scattering surface 14, and inclined blades 16 formed by shaving which are disposed at the innermost side arranged at the forward open end portion of the air supply duct 2. The liquid fuel scattering means 13 constructed as aforementioned is supported by a fuel supply line 17 extending through the air supply duct 2 and forcedly rotated by a jet of stream of air blast supplied through the air blast duct 2. Each inclined blade 16 is surrounded by ventilatory openings 18, while the scattering surface 14 is disposed beneath the outlet ports 11. Thus, the fuel released through the outlet ports 11 drops onto the surface of the scattering surface 14 from which it is scattered in atomized particles into the interior of the main body 1 of the burner.

19 is a fuel spray nozzle mounted at the forward end of the fuel supply line 17, and 20 an ignition plug for starting the combustion of the liquid fuel in gasified form.

In the burner for burning liquid fuel in gasified form constructed as aforementioned, a stream of air blast supplied through the air supply duct 2 under pressure impinges on the inclined blades 16 and causes the liquid fuel scattering means 13 to rotate at high speed about the fuel supply line 17 as the shaft. At the same time, the air blast is ejected into the interior of the fuel gasifying member 7 through the ventilatory openings 18 formed in the liquid fuel scattering means 13. By supplying a liquid fuel in atomized particles through the fuel spray nozzle 19, the liquid fuel moves along the inner wall surface of the fuel gasifying member 7 and passes through the outlet ports 11 onto the rotating scattering surface 14. The liquid fuel reaching the scattering surface 14 is ejected in atomized particles against the inner surface of the main body 1 of the burner by virtue of the centrifugal forces and the jet stream of air blast supplied under pressure, and ignited by means of the ignition plug 20 so as to instantly initiate combustion of the liquid fuel in atomized particles. The fuel gasifying member 7 is heated to a fuel gasifying atmosphere temperature by the flames of combustion of the liquid fuel in atomized particles.

As a result of heating of the fuel gasifying member 7, the liquid fuel scattered in atomized particles into the interior of the fuel gasifying member 7 after initiation of combustion of the liquid fuel in atomized particles is subjected to the flow-down preventing and diffusing action of the flow-down preventing member 9 and the air blast diffusing action of the stream of air blast supplied under pressure, so that the liquid fuel is caused to diffuse in thin film form. The diffusing liquid fuel in thin film form is quickly converted into gasified form as it is vaporized and gasified only by the heating action, and the gasified fuel thus produced is agitated and mixed with the air blast supplied under pressure while passing through the gas-air mixing plate 10 and the narrow gas passageway 15, so that a perfect mixture of gasified fuel and air is produced and supplied under pressure into the gas chamber 6. The mixture of gasified fuel and air is ejected evenly through the gas ejection ports 5 into the main body 1 of the burner to sustain combustion of the fuel in blue flames.

Figure 2:
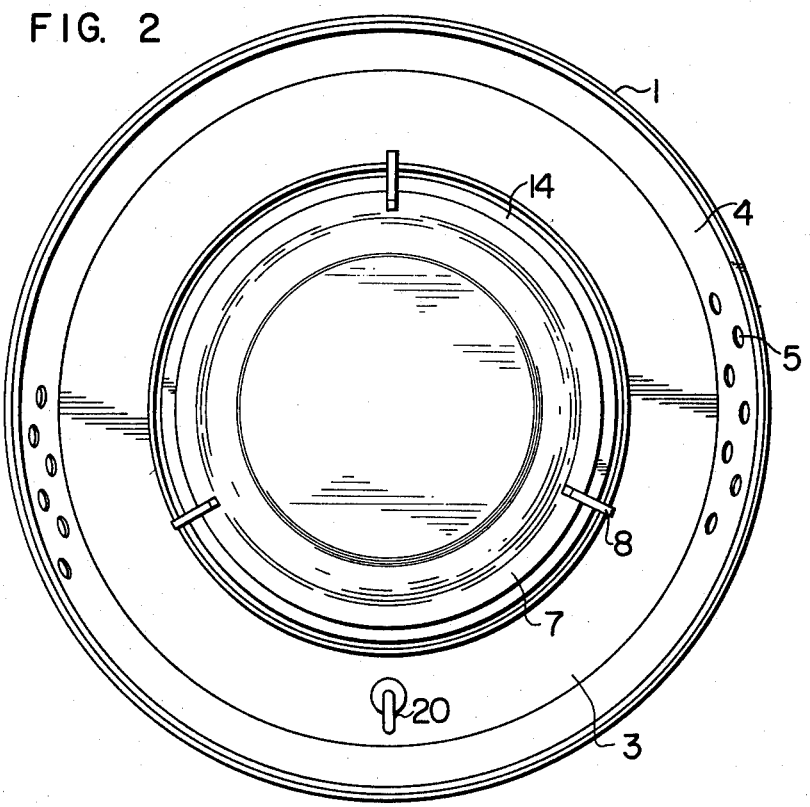
FIG. 2 is a side view of the burner shown in FIG. 1 as seen from the left side of FIG. 1.
Figure 3:
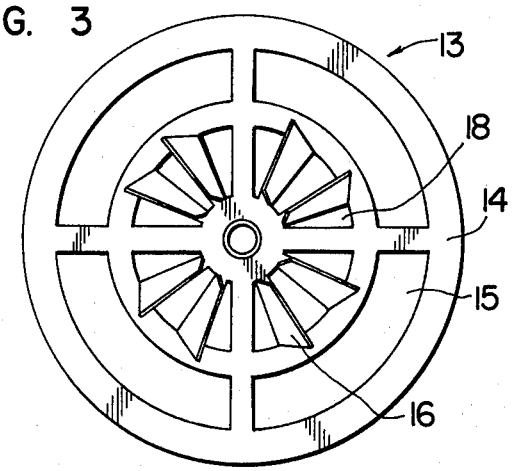
FIG. 3 is a side view of the liquid fuel scattering means of the burner shown in FIG. 1.
Figure 4:
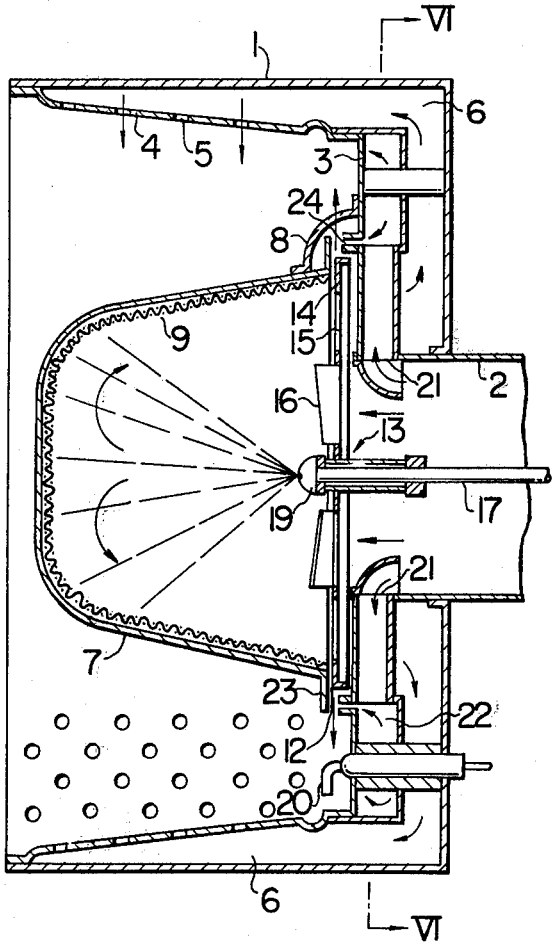
FIG. 4 is a vertical sectional view, with certain parts being cut out, of a second embodiment of the invention which has the specific effects of preventing damage by combustion to the fuel gasifying member and promoting atomization of the scattered liquid fuel in minuscule particles.
Figure 5:
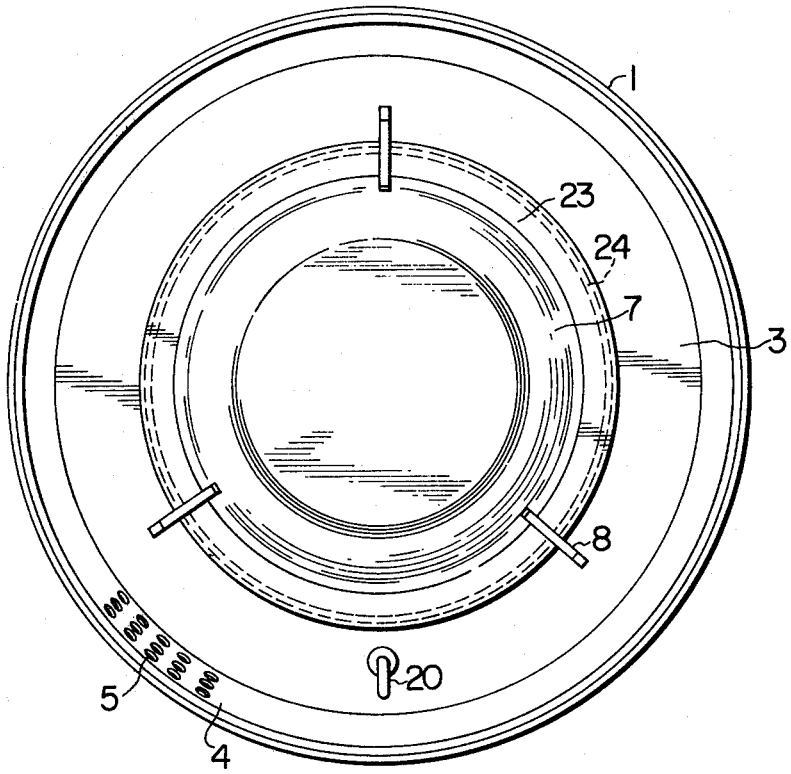
FIG. 5 is a side view of the burner shown in FIG. 4 as seen from the left side of FIG. 4.
Figure 6:
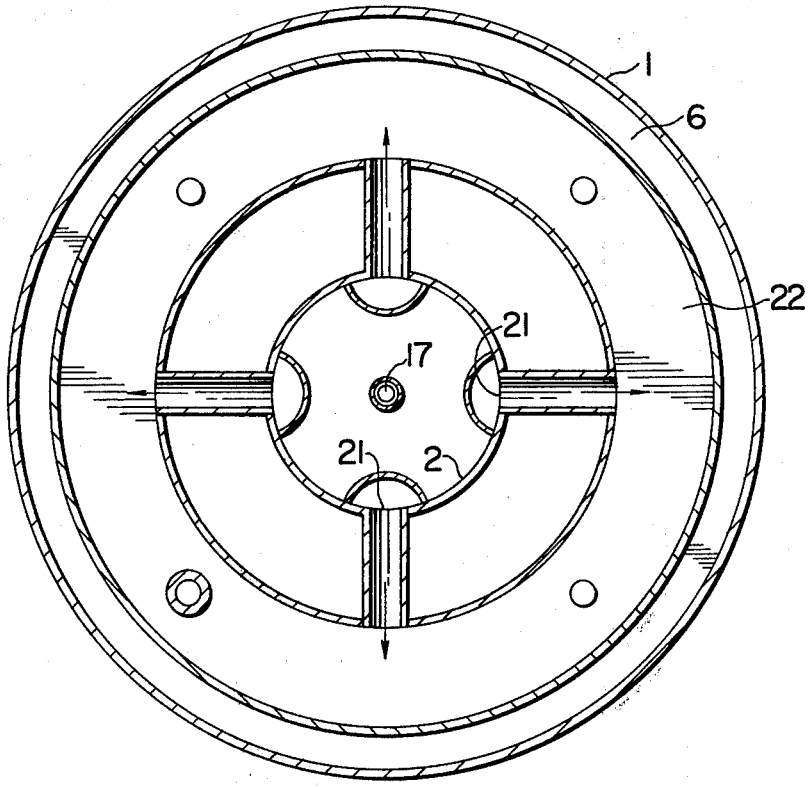
FIG. 6 is a sectional view taken along the line VI—VI of FIG. 4.

The aforementioned description refers to the basic form of the burner for burning liquid fuel in gasified form according to the invention as shown in FIG. 1 to FIG. 3. A burner for burning liquid fuel in gasified form shown in FIG. 4 to FIG. 6 provides improvements in the basic form of the burner. The improvements provided have the effect of avoiding damage by the flames of combustion to the fuel gasifying member 7 even if the latter is made of a thin metallic material, e.g. sheet metal, and enabling combustion of not only a liquid fuel in atomized particles but also a fuel in gasified form to take place efficiently. The improvements also promote combustion of the liquid fuel in atomized particles by converting the fuel scattered in minuscule particles by the liquid fuel scattering means 13 into still smaller particles.

In the aforesaid second embodiment of the invention shown in FIG. 4 to FIG. 6, there is provided, between the inner wall plate 3 and the gas chamber 6 provided in the outer marginal portion of the main body 1 of the burner, a cooling chamber 22 which communicates with the air supply duct 2 through air supply ports 21 and a plurality of air supply cylindrical members. Air ejection slits 24 are formed in a portion of the inner wall plate 3 which cooperates with the gas chamber 6 to define the cooling chamber 22. The air ejection slits 24 are arranged such that the air blast moving therethrough in a plurality of substreams of air blast impinges on an outwardly bent end portion 23 of the fuel gasifying member 7, so that the air blast can be ejected all at once against the inner wall surface of the fuel gasifying member 7.

Thus, part of the air blast supplied under pressure through the air supply duct 2 is introduced through air supply ports 21 into the cooling chamber 22 from which it is ejected through the air ejection slits 24. While the part of the air blast moves in this way, it performs the function of cooling the inner wall plate 3 which would otherwise be damaged by the flames of combustion, and it also performs the function of reducing the size of the atomized particles by impinging on the liquid fuel in atomized particles scattered by the fuel scattering means 13. This enables ignition and combustion of the liquid fuel in atomized particles to take place quckly and positively and at the same time promotes effective combustion of the liquid fuel in atomized particles.

Figure 7:
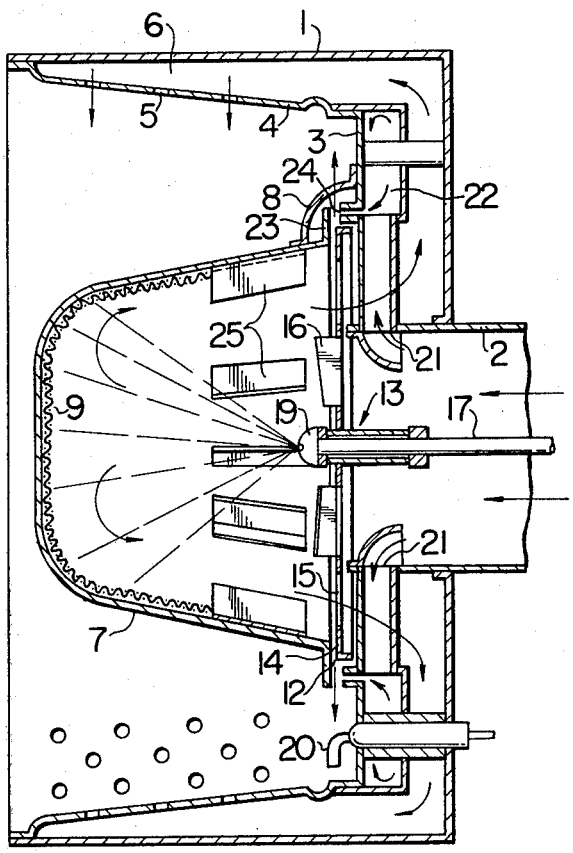
FIG. 7 is a vertical sectional view, with certain parts being cut out, of a third embodiment of the invention which comprises a multitude of heat dissipating fins mounted inside the fuel gasifying member.
Figure 8:
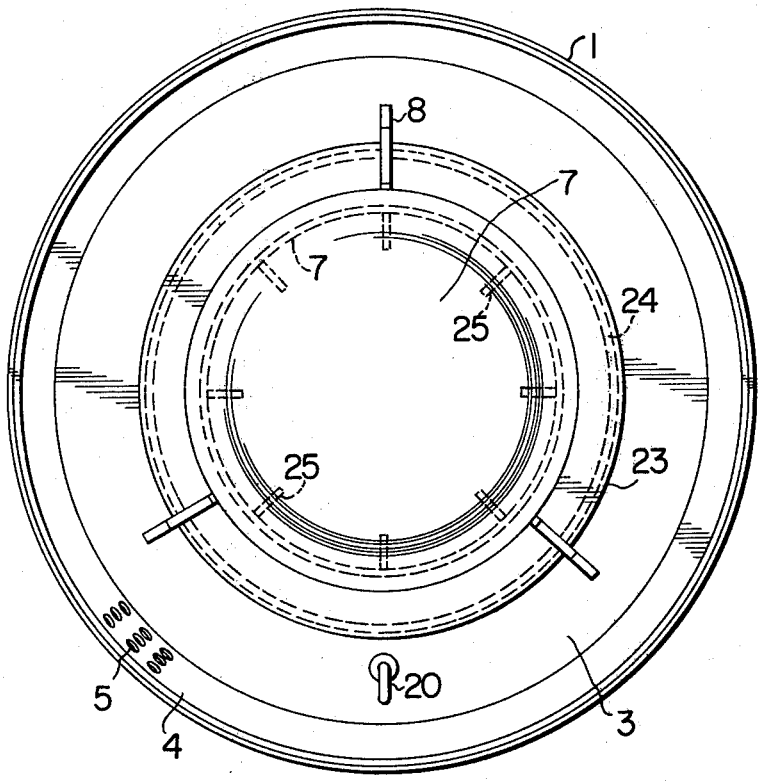
FIG. 8 is a side view of the burner shown in FIG. 7 as seen from the left side of FIG. 7.
Figure 9:
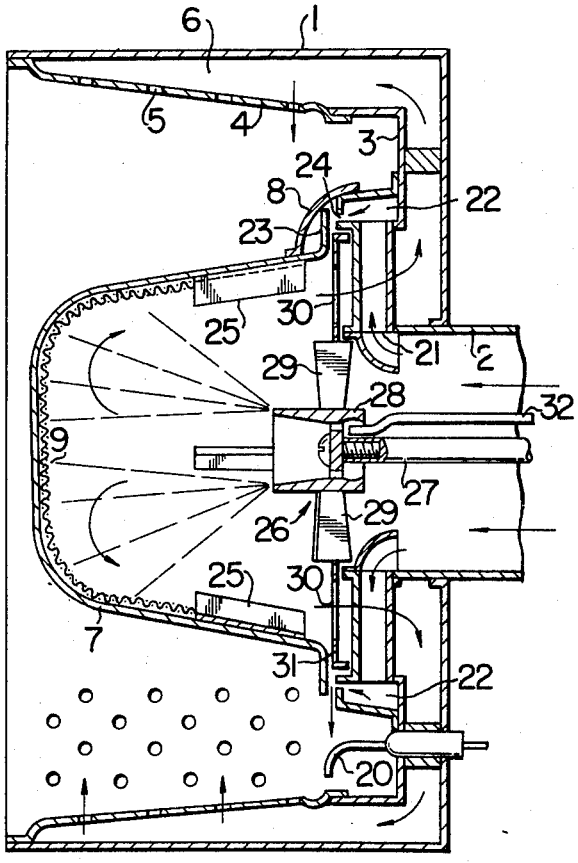
FIG. 9 is a vertical sectional view, with certain parts being cut out, of the third embodiment wherein the liquid fuel scattering means is directly supported by a rotary shaft.

FIG. 7 to FIG. 9 show a third embodiment of the invention which provides an improvement in basic form of the burner for burning liquid fuel in gasified form. The improvement enables the fuel gasifying member 7, even if it is made of a thin metallic material, e.g. sheet metal to perform the fuel gasifying function satisfactorily without the fuel gasifying member 7 being damaged by the flames of combustion, thereby enabling combustion of the liquid fuel in gasified form to be sustained satisfactorily More specifically, the improvement provided by the third embodiment of the invention comprises a number of heat dissipating fins 25 arranged on the inner periphery of the stationary fuel gasifying member 7 and disposed substantially equidistantly from one another. Thus, it will be seen that the heat dissipating action of the heat dissipating fins 25 is effective to prevent damage to the fuel gasifying member 7 which would otherwise be caused thereto in case the fuel gasifying member 7 is made of a thin metallic material, both at the time when the liquid fuel is burned in atomized particles and during the time combustion of the liquid fuel in gasified form is sustained. In principle, the third embodiment of the burner for burning liquid fuel in gasified form employs the liquid fuel scattering means 13 which is used in the basic form of the burner according to the invention. However, in the third embodiment, a modified form of liquid fuel scattering means 26 may be employed as shown in FIG. 9 for scattering the liquid fuel in atomized particles into the interior of the fuel gasifying member 7.

More specifically, the liquid fuel scattering means 26 of the third embodiment shown in FIG. 9 is distinguished from the liquid fuel scattering means 13 of the first embodiment in that whereas the latter rotates about the fuel supply line 17 as the shaft by virtue of the air blast impinging thereon after being supplied under pressure through the air supply duct 2, the former is directly supported by a rotary shaft 27 so that it rotates as the rotary shaft 27 rotates. The liquid fuel scattering means 26, which is fabricated from a disk, comprises a cup-shaped scattering member 28 disposed in the center for ejecting and scattering the liquid fuel in minuscule particles onto the inner wall surface of the fuel gasifying member 7, air-current setting-up blades 29 formed by shaving and disposed outwardly of the scattering member 28, the scattering member 28 and the air-current setting-up blades 29 being disposed within the air supply duct 2, and gasified fuel-air mixture passageways 30 and a scattering surface 31 formed integrally with each other and disposed outwardly of the air-current setting-up blades 29. Ventiratory openings for permitting substreams of the air blast to pass therethrough are formed in the disk in portions thereof which have been shaved to provide the air-current setting-up blades 29, and a fuel supply line 32 has a forward end portion which is inserted in the scattering member 28 to open therein.

Upon rotation of the rotary shaft 27, the liquid fuel scattering means 26 constructed as aforementioned is forcedly rotated. If a liquid fuel is supplied at the same time through the fuel supply line 32, then the fuel is scattered in minuscule particles onto the inner wall surface of the fuel gasifying member 7 by the cup-shaped scattering member 28, and the fuel which has been caused to move and diffuse along the inner wall surface of the fuel gasifying member 7 is scattered in minuscule particles into the interior of the main body 1 of the burner by the scattering surface 31 to initiate combustion of the liquid fuel in atomized particles. Following initiation of combustion of the liquid fuel in atomized particles, the fuel gasifying member 7 is heated quickly by the flames of combustion of the liquid fuel in atomized particles in the main body 1 of the burner, so that the fuel scattered onto the inner wall surface of the fuel gasifying member 7 is quickly converted into gasified form and mixed with the air blast supplied under pressure. Thus, a mixture of gasified fuel and air can be ejected through the gas ejection ports 5 formed in the combustion plate 4 to sustain combustion of the liquid fuel in gasified form.

Figure 10:
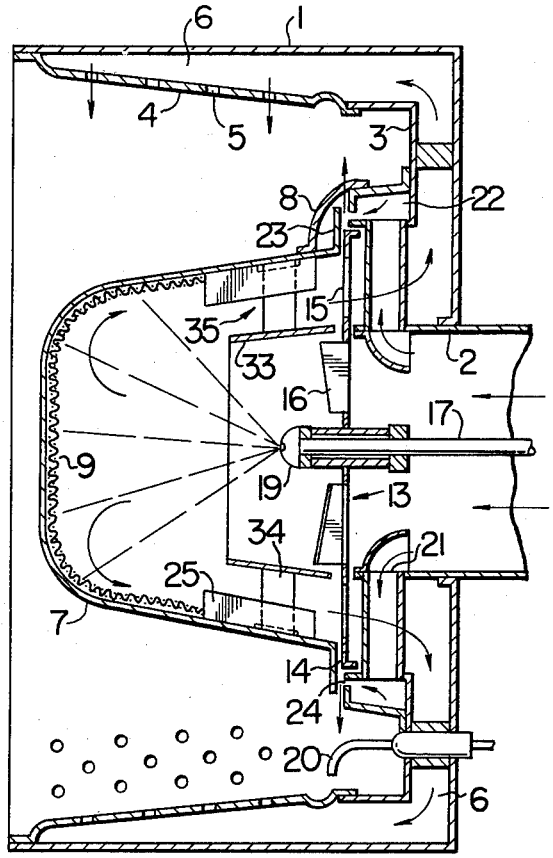
FIG. 10 is a vertical sectional front view, with certain parts being cut out, of a fourth embodiment of the invention wherein a cylindrical air guide is inserted in the fuel gasifying member having mounted therein a multitude of heat dissipating fins.
Figure 11:
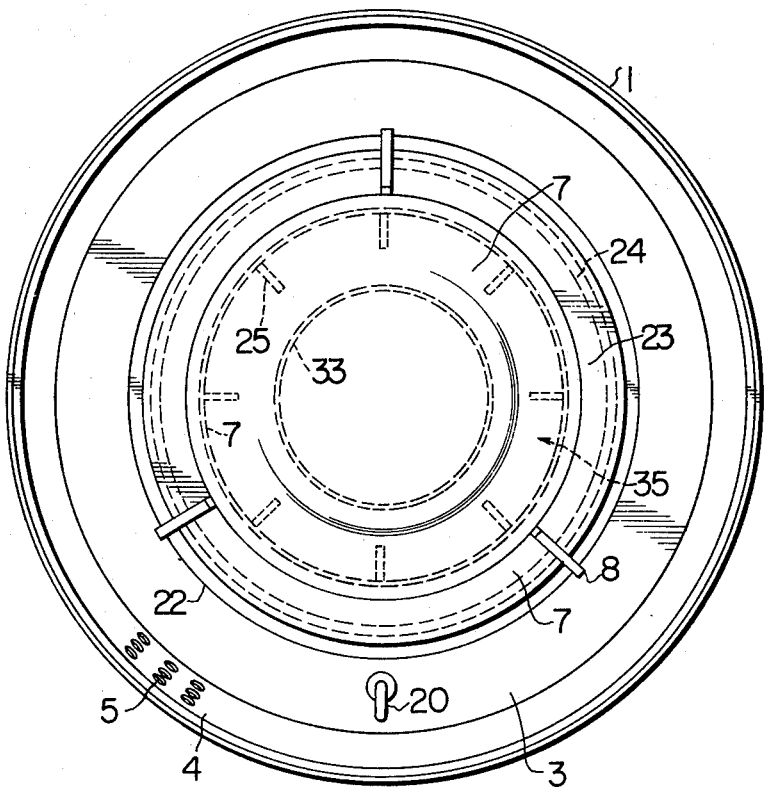
FIG. 11 is a side view of the burner shown in FIG. 10 as seen from the left side of FIG. 10.

FIG. 10 and FIG. 11 show a fourth embodiment of the invention which is more effective than the basic form of the burner according to the invention in producing a mixture of gasified fuel and air of better proportions, so that a perfect gasified fuel-air mixture can be obtained. In the embodiment shown in FIG. 10 and FIG. 11, a cylindrical air guide 33 is arranged forwardly of the front opening of the air supply duct 2 or within the fuel gasifying member 7 and in a position which is interior to the fuel scattering means 13, and fixed by mounting bars 34 to the inner wall of the fuel gasifying member 7, with a narrow gasified fuel-air mixture passageway 35 being defined between the fuel gasifying member 7 and the cylindrical air guide 33.

The provision of the cylindrical air guide 33 inserted deep into the fuel gasifying member 7 and disposed therein to define the narrow gasified fuel-air mixture passageway 35 between it and the fuel gasifying member 7 enables the gasified fuel produced in the fuel gasifying member 7 and the air blast supplied under pressure into the interior of the fuel gasifying member 7 to be agitated and mixed well while passing through the narrow gasified fuel-air mixture passageway 35. Thus, it is possible to produce a gasified fuel-air mixture of perfect proportions and to enable combustion of such mixture in uniform blue flames to be sustained. This feature makes the burner according to the invention fit for use as a heating source which is useful in many applications.

From the foregoing description, it will be appreciated that the burner for burning liquid fuel in gasified form constructed as aforesaid is capable of quickly and positively scattering in minuscule particles in the main body 1 of the burner a supplied liquid fuel by means of the rotating fuel scattering means 13, although the fuel gasifying member 7 arranged in the main body 1 of the burner is non-rotatable and remains stationary. This not only enables combustion of the liquid fuel in atomized particles to commence at once to thereby heat the fuel gasifying member 7, but also permits the liquid fuel diffusing along the inner wall surface of the fuel gasifying member 7 to be quickly converted into gasified form by the heating action of the flames of combustion of the liquid fuel in atomized particles. The gasified fuel produced in this way is positively mixed within the fuel gasifying member 7 with an air blast supplied thereto under pressure to thereby produce a mixture of gasified fuel and air which is vigorously emitted through the gas ejection ports 5 formed in the combustion plate 4 to sustain combustion of the liquid fuel in gasified form.

The burner for burning liquid fuel in gasified form according to the invention, although simple in construction and low in cost, enables to automatically switch from combustion of a liquid fuel in atomized particles to combustion of the fuel in gasified form. At the same time, the provision of the cooling chamber 22 is effective to prevent damage which would otherwise be caused to the inner wall plate 3 of the main body 1 of the burner by the flames of combustion. With the burner according to the invention, the liquid fuel in minuscule particles can be further reduced in size to expedite initiation of combustion of the liquid fuel in atomized particles, so that perfect combustion of the fuel can be achieved. Moreover, the provision of the heat dissipating fins 25 on the inner wall surface of the fuel gasifying member 7 is effective to avoid damage to the fuel gasifying member 7 by the flames of combustion even if the member 7 is fabricated by using a thin metallic material and to gasify the liquid fuel satisfactorily. Furthermore, the provision of the cylindrical air guide 33 enables the produced gasified fuel and the air blast supplied under pressure to be thoroughly mixed with each other when passing through the narrow gasified fuel-air mixture passageway 35 defined between the cylindrical air guide 33 and the fuel gasifying member 7, so that a mixture of gasified fuel and air of proper proportions can be ejected for combustion. It will be seen that the burner for burning liquid fuel in gasified form comprising the aforesaid features according to the invention has a high heating efficiency.

What is claimed is:

1. A burner for burning liquid fuel in gasified form comprising:

a main body of the burner;

an air supply duct inserted in said main body of the burner at one side thereof;

a gas chamber formed in an outer marginal portion of said main body of the burner by mounting a combustion plate along inner periphery of the main body in spaced-apart relationship;

a fuel gasifying member non-rotatably mounted in said main body of the burner and maintained in communication with said gas chamber; and liquid fuel scattering means rotatably mounted at an open end portion of said fuel gasifying member for scattering the liquid fuel in the interior of said main body of the burner through a scattering gap formed between said liquid fuel gasifying member and said fuel scattering means.

2. A burner for burning liquid fuel in gasified form comprising:

a main body of the burner;

an air supply duct inserted in said main body of the burner at one side thereof;

a gas chamber formed in an outer marginal portion of said main body of the burner by mounting a combustion plate along inner periphery of the main body in spaced-apart relationship;

a fuel gasifying member non-rotatably mounted in said main body of the burner and maintained in communication with said gas chamber;

liquid fuel scattering means rotatably mounted at an open end portion of said fuel gasifying member for scattering the liquid fuel in the interior of said main body of the burner through a scattering gap formed between said fuel gasifying member and said liquid fuel scattering means; and a cooling chamber disposed adjacent an inner wall plate of said main body of the burner and maintained at one end thereof in communication with said air supply duct.

3. A burner for burning liquid fuel in gasified form comprising:

a main body of the burner;

an air supply duct inserted in said main body of the burner at one side thereof;

a gas chamber formed in an outer marginal portion of said main body of the burner by mounting a combustion plate along inner peripery of the main body in spaced-apart relationship;

a fuel gasifying member non-rotatably mounted in said main body of the burner and maintained in communication with said gas chamber;

liquid fuel scattering means rotatably mounted at an open end portion of said fuel gasifying member for scattering the liquid fuel in the interior of said main body of the burner through a scattering gap formed between said fuel gasifying member and said liquid fuel scattering means; and a number of heat dissipating fins attached to inner periphery of said non-rotatably mounted fuel gasifying member.

4. A burner for burning liquid fuel in gasified form comprising:

a main body of the burner;

an air supply duct inserted in said main body of the burner at one end thereof;

a gas chamber formed in an outer marginal portion of said main body of the burner by mounting a combustion plate along inner periphery of the main body in spaced-apart relationship;

a fuel gasifying member non-rotatably mounted in said main body of the burner and maintained in communication with said gas chamber;

liquid fuel scattering means rotatably mounted at an open end portion of said fuel gasifying member for scattering the liquid fuel in the interior of said main body of the burner through a scattering gap formed between said fuel gasifying member and said liquid fuel scattering means;

a cylindrical air guide arranged within said fuel gasifying member and maintained in communication with said air supply duct; and a narrow gasified fuel-air mixture passageway defined between said fuel gasifying member and said cylindrical air guide and connected to said gas chamber.

* * * * *